US006890201B2

(12) United States Patent
Hashiguchi et al.

(10) Patent No.: US 6,890,201 B2
(45) Date of Patent: May 10, 2005

(54) ZIF CONNECTOR HAVING A CONTACT OF UNIQUE SHAPE

(75) Inventors: Osamu Hashiguchi, Akishima (JP); Kazuki Saito, Akishima (JP); Toshiaki Ariyoshi, Utsunomiya (JP); Masahiko Sato, Utsunomiya (JP)

(73) Assignees: Japan Aviation Electronics Industry, Limited, Tokyo (JP); Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/620,046

(22) Filed: Jul. 15, 2003

(65) Prior Publication Data

US 2004/0014345 A1 Jan. 22, 2004

(30) Foreign Application Priority Data

Jul. 15, 2002 (JP) ..... 2002-205114
Nov. 20, 2002 (JP) ..... 2002-336287

(51) Int. Cl.[7] ..... H01R 13/15
(52) U.S. Cl. ..... 439/259; 439/342
(58) Field of Search ..... 439/259–270, 439/342

(56) References Cited

U.S. PATENT DOCUMENTS 3,963,317 A * 6/1976 Eigenbrode et al. ..... 439/267
4,343,524 A * 8/1982 Bright et al. ..... 439/268
4,560,222 A * 12/1985 Dambach ..... 439/373
5,021,000 A * 6/1991 Scheibner ..... 439/342
5,213,530 A * 5/1993 Uratsuji ..... 439/268
6,568,955 B2 * 5/2003 Hotea et al. ..... 439/495

FOREIGN PATENT DOCUMENTS

| | | |
|---|---|---|
| JP | 343146 | 12/1993 |
| JP | 8203622 | 8/1996 |
| JP | 2002-043006 | 2/2002 |

* cited by examiner

*Primary Examiner*—Gary Paumen
*Assistant Examiner*—James R. Harvey
(74) *Attorney, Agent, or Firm*—Collard & Roe, P.C.

(57) ABSTRACT

A zero insertion force connector (1) uses a contact (4) having a unique shape which is described below. That is, the contact includes a stationary portion (4A) fixed to an insulator (2), a first portion (4B) having a first contact point (4B1) and being continuous with the stationary portion, a substantially U-shaped portion (4C) continuous with the first portion, a second portion (4D) having a second contact point (4D1) and being continuous with the substantially U-shaped portion, and a movable portion (4E) continuous with the second portion and engaging with an actuator (5) held by the insulator to be slidable along the insulator. The first and the second contact points confront each other with a gap (W) left therebetween. The actuator slides to displace the movable portion so that the first and the second contact points sandwich therebetween a connection counterpart (13B) that is inserted in the gap.

18 Claims, 12 Drawing Sheets

ZIF CONNECTOR HAVING A CONTACT OF UNIQUE SHAPE

This invention claims priority to prior Japanese patent applications JP 2002-205114 and 2002-336287, the disclosures of which are incorporated herein by reference.

BACKGROUND OF THE INVENTION

The present invention relates to a connector that produces a large contact force between contacts thereof and contacts of a connection counterpart with a small operation force. Such a connector may generally be called a low insertion force connector or a zero insertion force connector which are collectively called a ZIF connector throughout the specification and the claims.

FIG. 12 shows a conventional ZIF connector, which corresponds to one described in JP-A-H05-343146. In FIG. 12, a housing 51 is formed with a plurality of holes 52 arranged in line at regular intervals. A contact 53 is received in each hole 52. Each contact 53 has a first contact member 53A and an elastically deformable second contact member 53B, which cooperatively form substantially a U-shape. Each of lead pins of a connection counterpart (not shown) is inserted between the corresponding first and second contact members 53A and 53B in a direction identified by an arrow. An actuator 54 and a cam 55 are further received in the housing 51. The actuator 54 has a plurality of projecting portions 54A corresponding to the contacts 53, respectively.

When the cam 55 is rotated in a direction of an arrow, the actuator 54 moves in a left direction in the figure. Then, each projecting portion 54A of the actuator 54 pushes the second contact member 53B of the corresponding contact 53. This causes each second contact member 53B to be elastically deformed so that each lead pin is sandwiched under pressure between the corresponding first and second contact members 53A and 53B. In this manner, the lead pins are connected to the contacts 53, respectively.

In the foregoing conventional ZIF connector, however, when the thickness of the lead pin is small, inasmuch as the displacement of the second contact member 53B is small, a sufficient contact force can not be produced between the lead pin and the first and second contact members 53A and 53B. Particularly, when the connector has a multi-contact structure with a small operation force, a sufficient displacement of the second contact member 53B can not be achieved to result in a small contact force, so that a reliable contact can not be ensured between the lead pin and the first and second contact members 53A and 53B.

Further, inasmuch as there is provided no lock mechanism for locking the movement of the cam 55, when a load such as vibration or impact is applied to the ZIF connector from the exterior after the connection counterpart is connected thereto, it may be possible that the cam 55 rotates in a reverse direction to release the fitted state between the contacts 53 and the lead pins so that the lead pins are disengaged from the contacts 53.

There have been proposed other ZIF connectors as described in, for example, JP-A-H08-203622 and JP-A-200243006, wherein, however, the foregoing problems are still outstanding.

SUMMARY OF THE INVENTION

It is therefore an object of the present invention to provide a ZIF connector that can produce a large contact force between contacts thereof and contacts of a connection counterpart with a small operation force irrespective of whether each contact of the connection counterpart is thin or thick.

It is another object of the present invention to provide a ZIF connector with a lock mechanism that can stably maintain a fitted state between contacts thereof and contacts of a connection counterpart during connection therebetween even when a load such as vibration or impact is applied thereto from the exterior.

Other objects of the present invention will become clear as the description proceeds.

According to one aspect of the present invention, there is provided a ZIF connector comprising an insulator, a contact held by the insulator, and an actuator slidably held by the insulator, the contact comprising a stationary portion fixed to the insulator, a first portion having a first contact point and being continuous with the stationary portion, a substantially U-shaped portion continuous with the first portion, a second portion having a second contact point and being continuous with the substantially U-shaped portion, and a movable portion continuous with the second portion and engaging with the actuator. The first and the second contact points confront each other with a gap left therebetween. The actuator slides to displace the movable portion so that the first and the second contact points sandwich therebetween a connection counterpart that is inserted in the gap.

According to another aspect of the present invention, there is provided a ZIF connector comprising an insulator holding a plurality of first contacts, an actuator slidably holding by the insulator, and a cam mechanism having a cam portion. In the ZIF connector, when the cam portion is operated to slide the actuator, the actuator displaces movable portions of the first contacts so that the first contacts and a plurality of second contacts of a connection counterpart are brought into a fitted state where the first contacts are connected to the second contacts, respectively. The ZIF connector further comprises a cam lock mechanism for retaining the fitted state.

BRIEF DESCRIPTION OF THE DRAWING

FIGS. 1A to 1D show a socket connector according to a first preferred embodiment of the present invention, wherein FIG. 1A is a front view, FIG. 1B is a plan view, FIG. 1C is a rear view, and FIG. 1D is a side view;

FIGS. 2A to 2C show a pin connector as a connection counterpart of the socket connector, wherein FIG. 2A is a front view, FIG. 2B is a plan view, and FIG. 2C is a side view;

FIGS. 3A to 3D show a socket contact of the socket connector, wherein FIG. 3A is a front view, FIG. 3B is a side view, FIG. 3C is a rear view, and FIG. 3D is a bottom view;

FIGS. 4A and 4B are enlarged sectional views of the socket connector, wherein FIG. 4A shows the state before the pin connector is connected to the socket connector, while FIG. 4B shows the state after the pin connector is connected to the socket connector;

FIG. 5B is an enlarged sectional view taken along line A—A in FIG. 1A, FIGS. 6A and 6B are sectional views each taken along line C—C in FIG. 1D, wherein FIG. 6A shows the state before the pin connector is connected to the socket connector, while

FIGS. 7A and 7B are sectional views showing a socket connector according to a second preferred embodiment of the present invention, wherein FIG. 7A shows the state before the pin connector is connected to the socket connector, while FIG. 7B shows the state after the pin connector is connected to the socket connector;

FIGS. 8A to 8D show a socket connector according to a third preferred embodiment of the present invention, wherein FIG. 8A is a front view, FIG. 8B is a plan view, FIG. 8C is a rear view, and FIG. 8D is a side view;

FIGS. 9A and 9B are sectional views each taken along line C—C in FIG. 8B, wherein FIG. 9A shows the state before the pin connector is connected to the socket connector, while FIG. 9B shows the state after the pin connector is connected to the socket connector;

FIGS. 10A to 10D are enlarged rear views showing the main part of FIG. 8C, wherein FIG. 10A shows an open state of a cam lock mechanism provided in the socket connector shown in FIGS. 8A to 8D, FIG. 10B shows an intermediate state thereof from the open state to a lock state, FIG. 10C shows the lock state thereof, and FIG. 10D shows a state thereof upon releasing the lock state;

FIGS. 11A and 11B are diagrams for explaining an internal structure of the cam lock mechanism, wherein FIG. 11A is a sectional view taken along line A—A in FIG. 10C, and FIG. 11B is a sectional view taken along line B—B in FIG. 10C.

DESCRIPTION OF THE PREFERRED EMBODIMENTS

Now, preferred embodiments of the present invention will be described hereinbelow with reference to the drawings.

A ZIF connector according to the first embodiment of the present invention will be described with reference to FIGS. 1A to 6B.

Figures 1A, 1B, 1C, 1D:
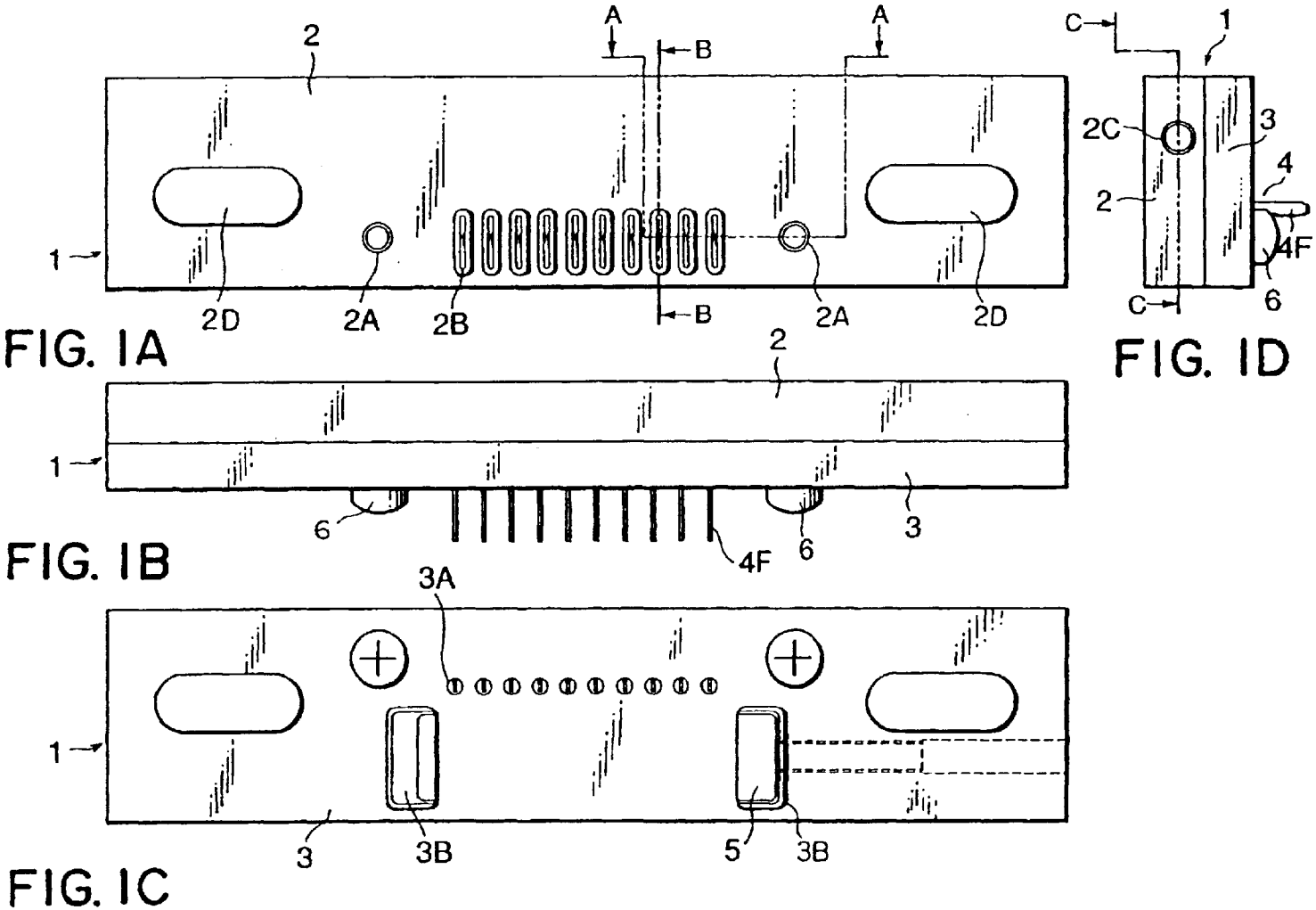

FIGS. 1A to 1D show a socket connector 1, wherein FIG. 1A is a front view, FIG. 1B is a plan view, FIG. 1C is a rear view, and FIG. 1D is a side view. The socket connector 1 comprises a front insulator 2, a base insulator 3 confronting the front insulator 2, a lot of socket contacts 4 retained or held by the front insulator 2, an actuator 5 received between the front insulator 2 and the base insulator 3, two fixing screws 6 for fixing the front insulator 2 and the base insulator 3 together, and a driving screw 7 (see FIG. 6B) for driving the actuator 5.

The actuator 5, when moved, accomplishes engagement and disengagement between the socket contacts 4 and pin contacts 13 of a pin connector 11 (see FIGS. 2A to 2C) as a connection counterpart.

On a side of the base insulator 3 corresponding to the back side of the socket connector 1, a lot of terminal holes 3A are provided for allowing terminals 4F of the socket contacts 4 to project therethrough, and two windows 3B are also provided for showing a moving state of the actuator 5.

On a side of the front insulator 2 corresponding to the front side of the socket connector 1, two fixing screw holes 2A are provided for receiving therein the fixing screws 6 that are screwed from the side of the base insulator 3, a lot of contact insertion openings 2B are provided for inserting the pin contacts 13 therethrough, and two mounting holes 2D are further provided for mounting the socket connector 1 onto an electronic device or the like. On a lateral side of the front insulator 2, a driving screw hole 2C is provided for receiving therethrough the driving screw 7.

Figure 5B:
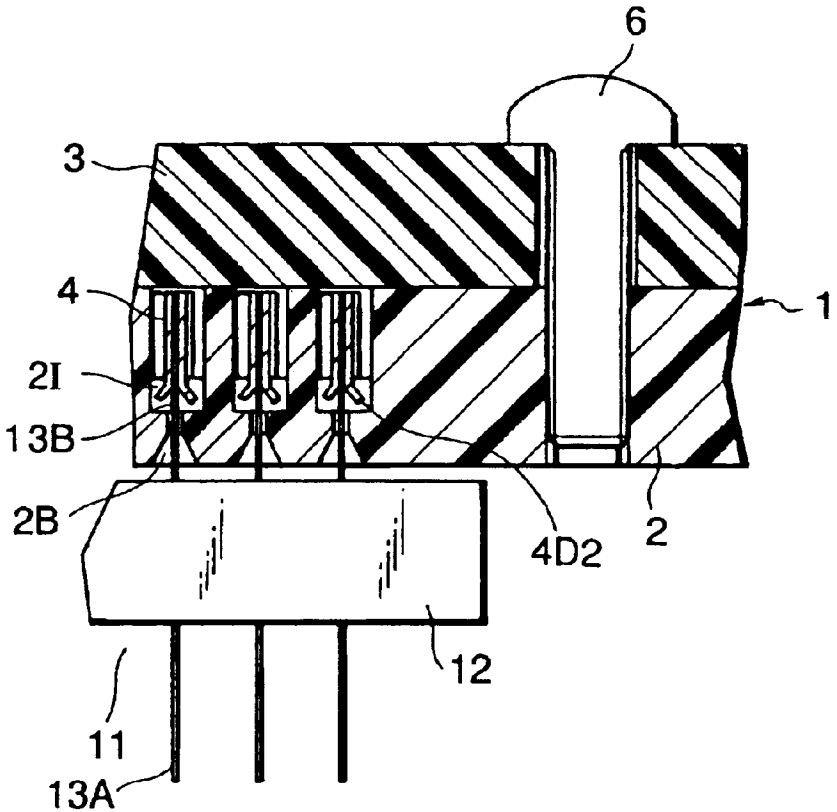
Figure 5A:
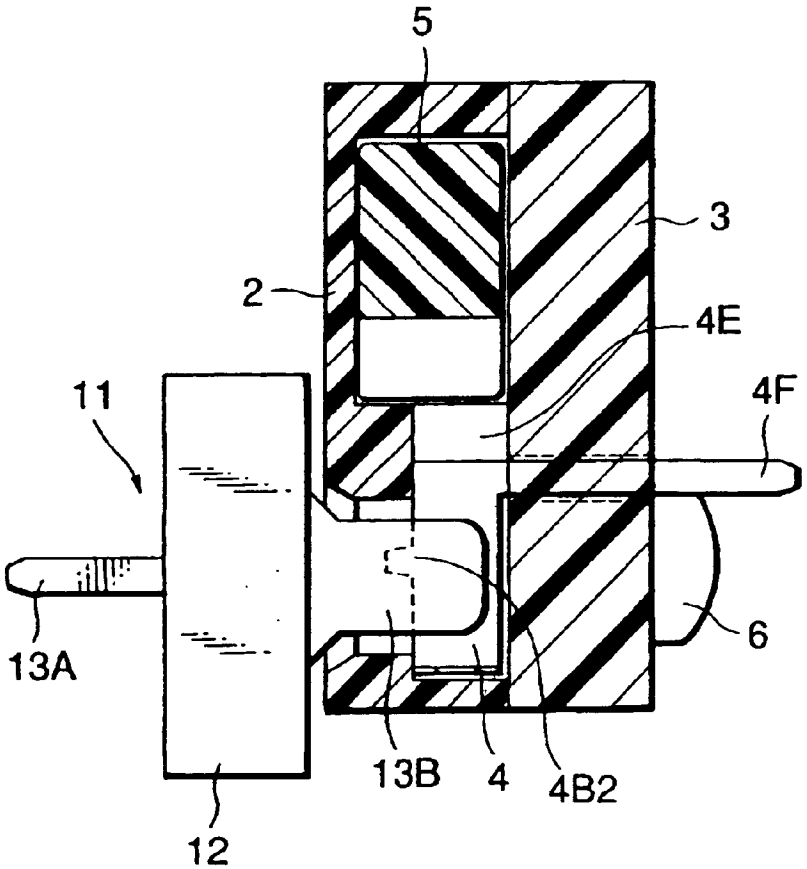
FIG. 5A is an enlarged sectional view taken along line B—B in FIG. 1A.

FIGS. 5A and 5B are diagrams showing a relationship among the front insulator 2, the base insulator 3, the socket contacts 4, the actuator 5, the fixing screw 6, and the pin connector 11. Specifically, FIGS. 5A and 5B are sectional views taken along line B—B and line A—A in FIG. 1A, respectively, wherein the pin connector 11 is connected to the socket connector 1. As appreciated, the pin connector 11 is not shown in section in the figures.

Figure 2C:
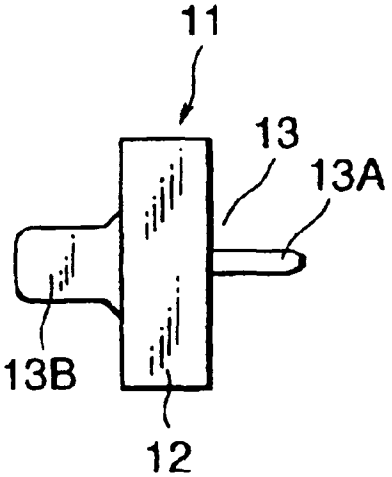
Figure 2A:
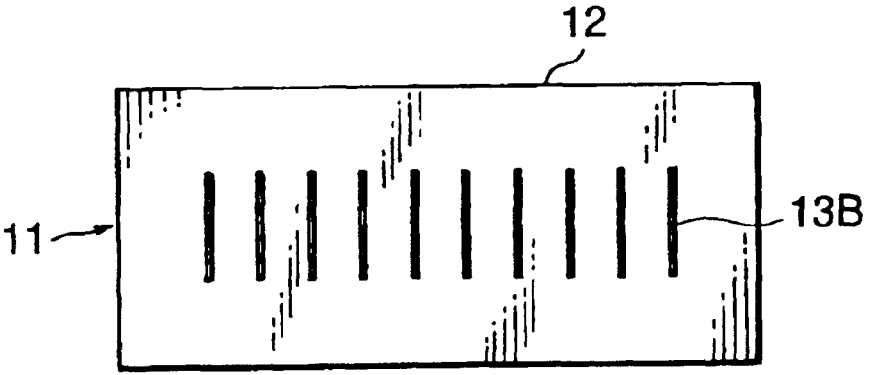
Figure 2B:
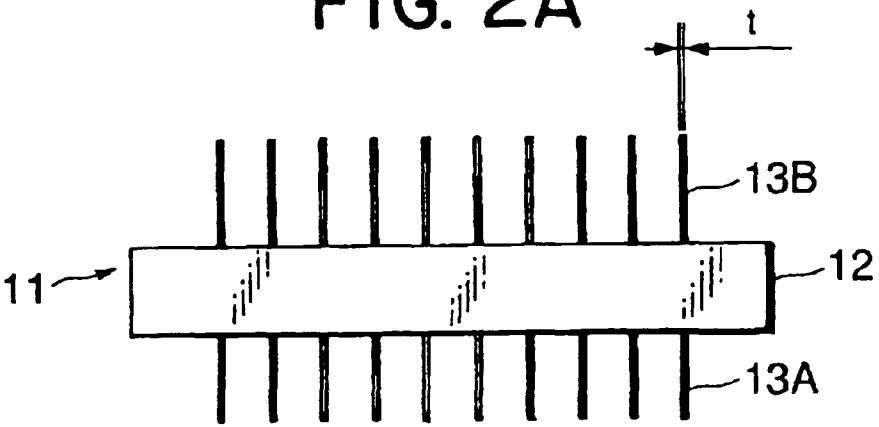

FIGS. 2A to 2C show the pin connector 11 as a connection counterpart of the socket connector 1, wherein FIG. 2A is a front view, FIG. 2B is a plan view, and FIG. 2C is a side view. The pin connector 11 comprises a housing 12, and the pin contacts 13 retained or held by the housing 12. Each pin contact 13 comprises a terminal 13A projecting from one side of the housing 12 for connection to a printed board, and a pin 13B in the form of a thin plate projecting from the other side of the housing 12 for connection to the corresponding socket contact 4. The thickness of the pin 13B is set to t.

Figure 3C:
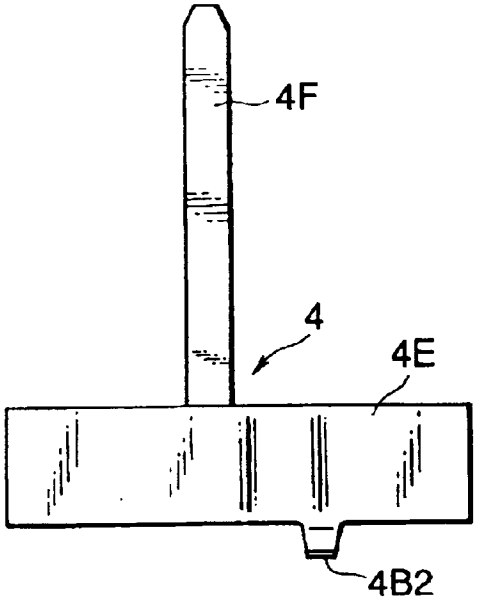
Figure 3B:
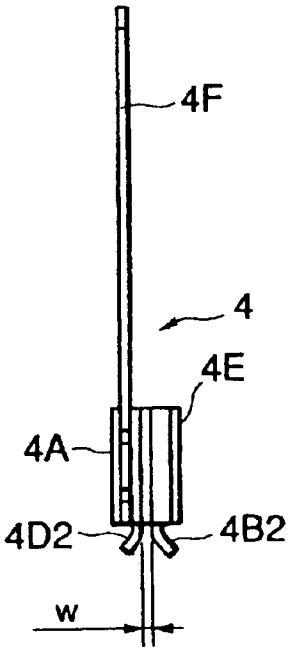
Figure 3D:
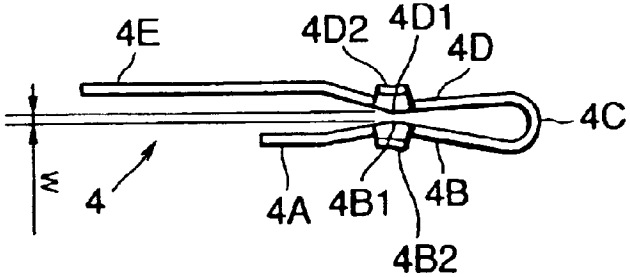
Figure 3A:
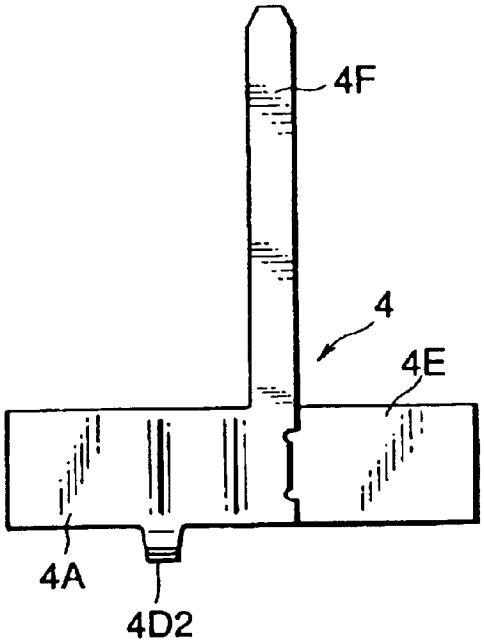

FIGS. 3A to 3D show the socket contact 4 of the socket connector 1, wherein FIG. 3A is a front view, FIG. 3B is a side view, FIG. 3C is a rear view, and FIG. 3D is a bottom view. In FIG. 3D, the socket contact 4 comprises a stationary portion 4A, a first or substantially <-shaped portion 4B continuous with the stationary portion 4A, a substantially U-shaped portion 4C continuous with the first portion 4B, a second or substantially <-shaped portion 4D continuous with the substantially U-shaped portion 4C, and a movable portion 4E continuous with the second portion 4D. Apexes of the first and second portions 4B and 4D serve as contact points 4B1 and 4D1, respectively. Further, guides 4B2 and 4D2 are symmetrically formed so as to extend outward from the contact points 4B1 and 4D1, respectively. The guides 4B2 and 4D2 serve to guide the pin 13B of the corresponding pin contact 13 so as to be introduced into a gap defined between the contact points 4B1 and 4D1 with zero insertion force without buckling of the pin 13B which would be otherwise caused due to interference with the socket contact 4. The gap has a width w that is set to be greater than the thickness t of the pin 13B. In order to make the gap become small, the first and second portions 4B and 4D are preformed or to have intermediate portions, respectively, which are bent to approach each other. As a result, a substantially <-shape is formed in each of the intermediate portions of the first and second portions 4B and 4D.

Figure 4A:
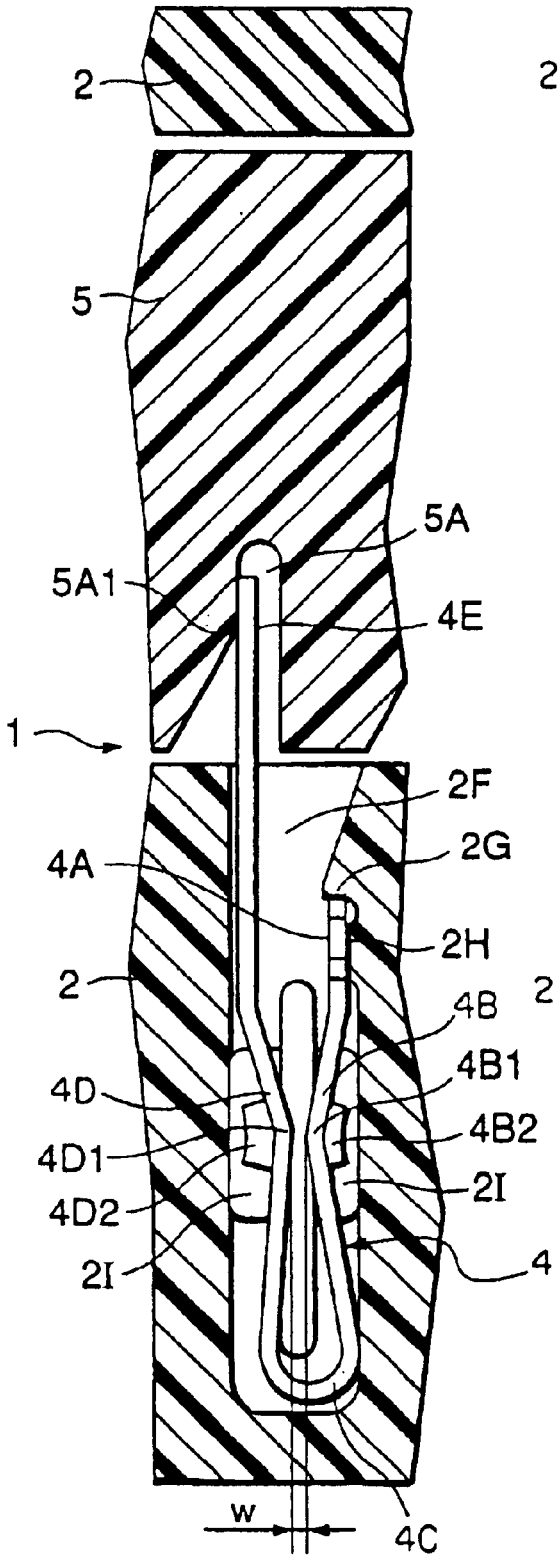
Figure 4B:
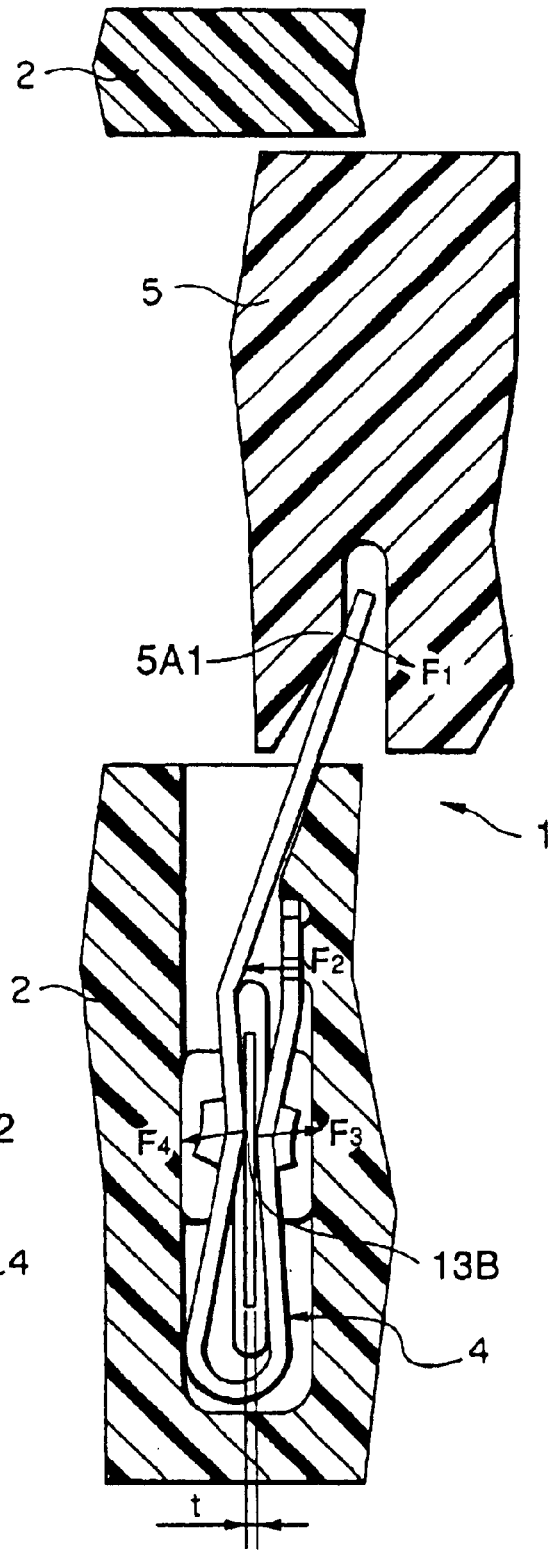

FIG. 4A shows the state where the pin connector 11 is not connected to the socket connector 1, i.e. where the pin 13B of each pin contact 13 is not inserted in the gap of the corresponding socket contact 4, and the actuator 5 is in an initial position. On the other hand, FIG. 4B shows the state where the pin connector 11 is connected to the socket connector 1, i.e. where the actuator 5 is driven to slide rightward in the figure after the pin 13B is inserted in the gap of the socket contact 4 so that the pin 13B is firmly fitted in the gap, i.e. sandwiched under pressure between the contact points 4B1 and 4D1 of the socket contact 4. In FIG. 4A, most of the socket contact 4 is received in a contact groove 2F of the front insulator 2, and a free end and a lateral side of the stationary portion 4A are in contact with a stopper 2G and a wall 2H of the front insulator 2, respectively. On the other hand, the movable portion 4E of the socket contact 4 is received in a movable portion groove 5A of the actuator 5. Further, the guides 4B2 and 4D2 of the socket contact 4 are received in guide grooves 21 of the front insulator 2.

When the actuator 5 in the initial position shown in FIG. 4A is driven to slide rightward to a position shown in FIG. 4B after the pin 13B of the pin contact 13 is inserted between the contact points 4B1 and 4D1 of the socket contact 4, the movable portion 4E of the socket contact 4 receives a force F1 from a cam portion 5A1 of the actuator 5 defined between a wall surface of the movable portion groove 5A extending in a direction perpendicular to a moving direction of the actuator 5 and an inclined wall surface of the movable portion groove 5A, so as to be displaced along the movable portion groove 5A. Accordingly, the socket contact 4 is elastically deformed so that the lateral side of the stationary portion 4A receives a force F2 from the wall 2H, and the contact points 4B1 and 4D1 sandwich under pressure both surfaces of the pin 13B therebetween, thereby to receive forces F3 and F4 from both surfaces of the pin 13B, respectively.

Figure 6A:
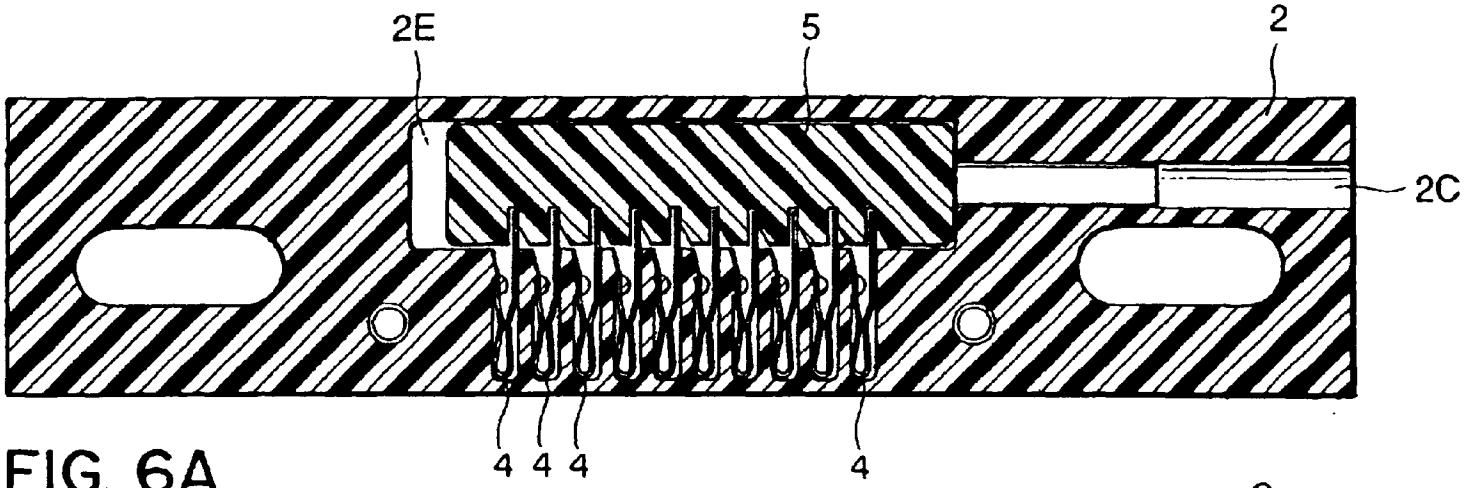
Figure 6B:
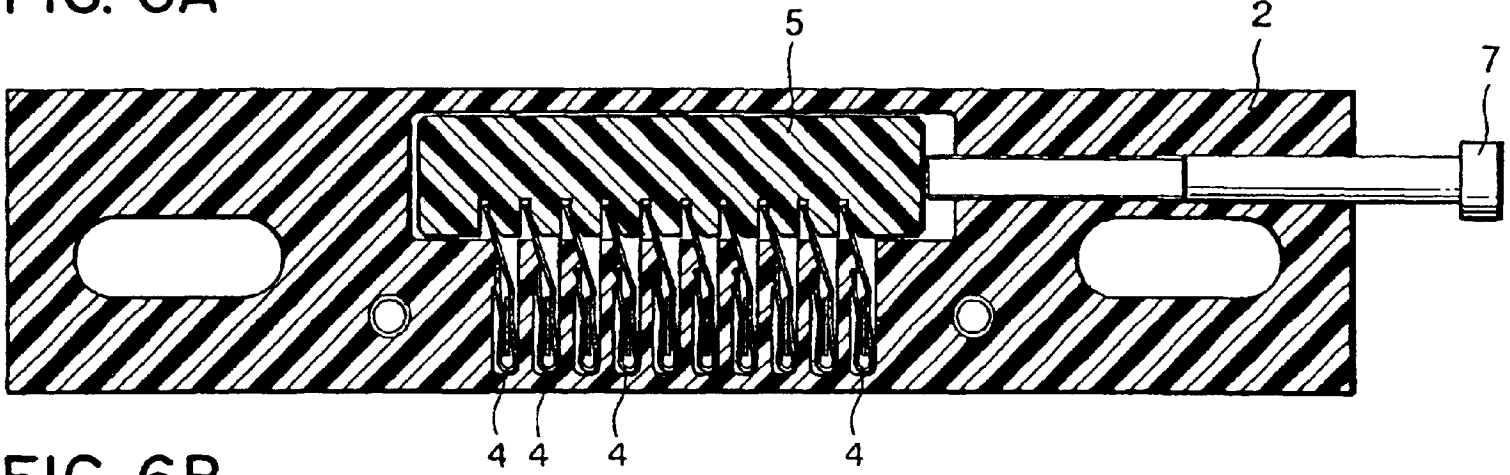
FIG. 6B shows the state after the pin connector is connected to the socket connector.

Referring to FIGS. 6A and 6B, description will be given about driving of the actuator 5. FIG. 6A is a sectional view taken along line C—C in FIG. 1D. The actuator 5 is received in an actuator groove 2E provided in the front insulator 2. After inserting the pins 13B of the pin contacts 13 of the pin connector 11 into the gaps formed between the contact points 4B1 and 4D1 of the socket contacts 4 of the socket connector 1, respectively, the driving screw 7 is inserted into the driving screw hole 2C. Then, when the driving screw 7 is rotated, the actuator 5 is moved to slide leftward in the figure. In this event, the cam portions 5A1 of the actuator 5 push the movable portions 4E of the socket contacts 4, respectively. Accordingly, the socket contacts 4 and the pins 13B of the pin contacts 13 are brought into the state shown in FIG. 6B, i.e. the state shown in FIG. 4B.

Now, the second embodiment of the present invention will be described with reference to FIGS. 7A and 7B. With respect to the second embodiment, description will be given only about those points that differ from the first embodiment while description of those points that are the same as or like the first embodiment will be omitted.

An actuator 22 of a socket connector 21 is provided with a cam hole 22A having substantially a rectangular shape in section, and a fan-shaped cam 23 is disposed in the cam hole 22A. The cam 23 is fixed on a shaft 24, and a lever 25 is also fixed on the shaft 24.

Figure 7A:
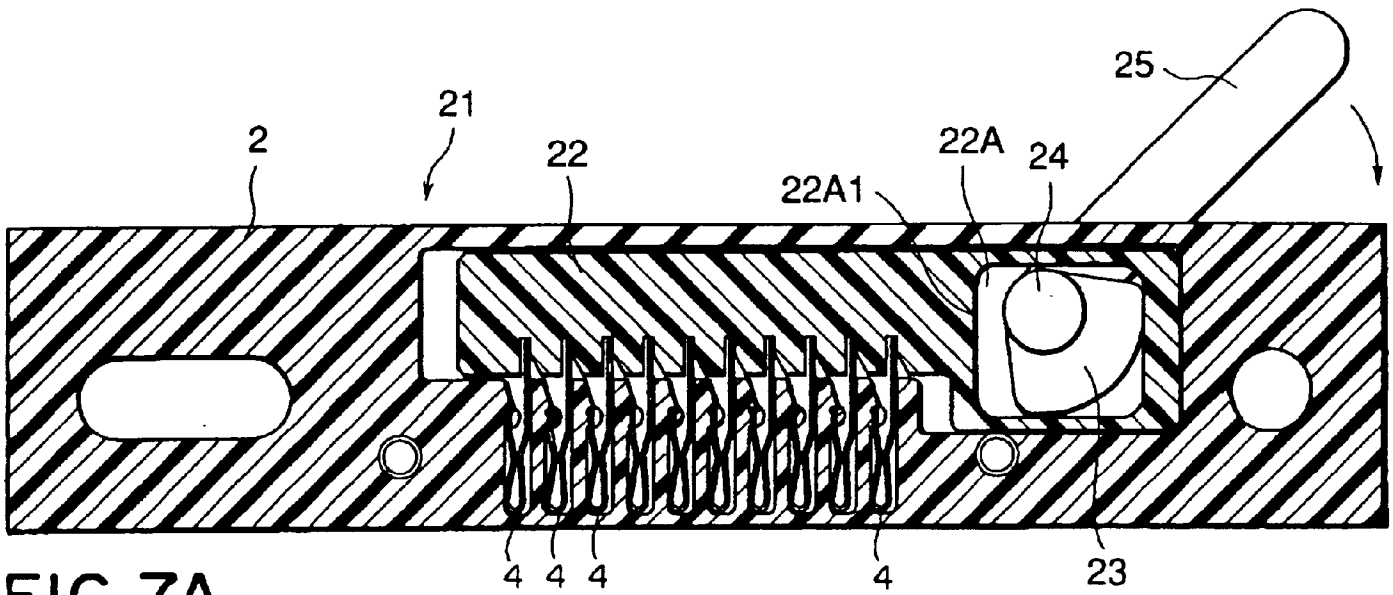

In FIG. 7A, when the lever 25 is rotated in a direction of an arrow with the shaft 24 as the center of rotation, the cam 23 rotates clockwise. In this event, the circumference of the cam 23 pushes a left side wall 22A1 of the cam hole 22A leftward in the figure, so that the socket contacts 4 and the pins 13B of the pin contacts 13 are brought into the state shown in FIG. 7B, i.e. like the state shown in FIG. 6B.

Figure 7B:
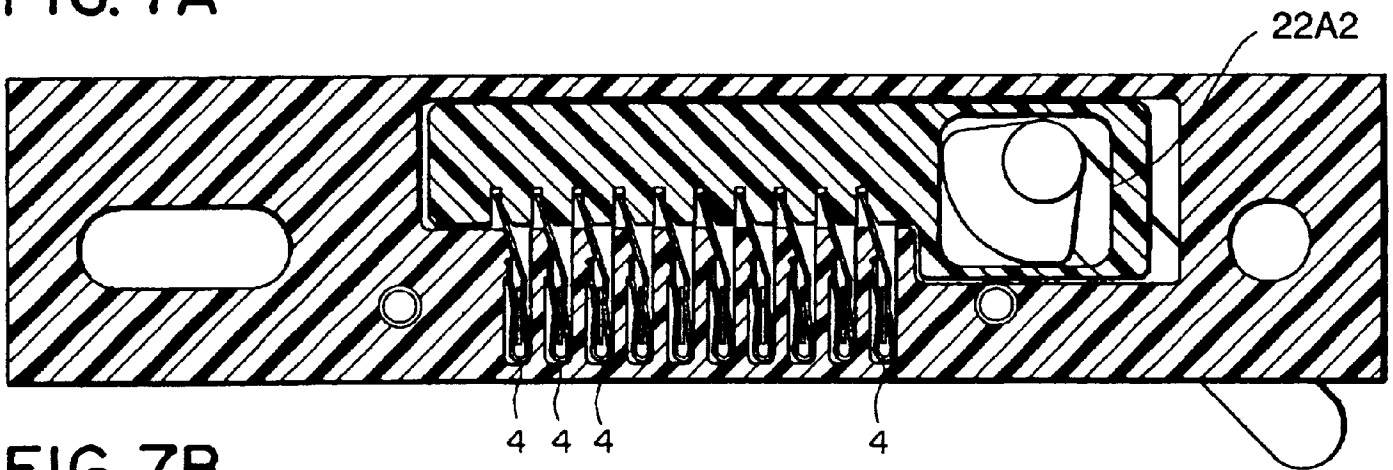

On the other hand, when releasing the engagement between the socket contacts 4 and the pins 13B of the pin contacts 13, the lever 25 is rotated counterclockwise with the shaft 24 as the center of rotation in FIG. 7B. Then, the circumference of the cam 23 pushes a right side wall 22A2 of the cam hole 22A rightward in the figure, so that the actuator 22 moves to the position shown in FIG. 7A thereby to release the engagement between the socket contacts 4 and the pins 13B of the pin contacts 13.

As described above, according to the foregoing first and second embodiments, each socket contact 4 is configured that the first and second portions 4B and 4D which are continuous with the opposite ends of the substantially U-shaped portion 4C are provided with the contact points 4B1 and 4D1, respectively, and the movable portion 4E extends continuously from the second portion 4D to engage with the cam portion of the actuator while the stationary portion 4A is provided so as to be continuous with the first portion 4B. Accordingly, even if an operation force is as small as that in the conventional multi-contact ZIF connector, a sufficient displacement is ensured between the contact points 4B1 and 4D1 to achieve an increased contact force, so that a stable and reliable contact can be accomplished irrespective of whether the pin 13B of the pin contact 13 is thin or thick.

The ZIF connector of the foregoing first or second embodiment is preferably applicable to a cell voltage detecting portion of a fuel cell. In the fuel cell, there is such an instance where a connector is connected to pins extending from a plurality of cells stacked at narrow intervals, thereby to detect cell voltages. In this event, if the ZIF connector of the foregoing first or second embodiment is applied thereto, those pins aligned at narrow intervals can be connected easily and securely with zero insertion force and without deformation thereof.

Now, the third embodiment of the present invention will be described with reference to FIGS. 8A to 11B. In these figures, the same or like members or components are assigned the same reference symbols as those in the foregoing first or second embodiment, thereby to only briefly refer to those members or components or fully omit description thereof for brevity of description.

Figure 8A:
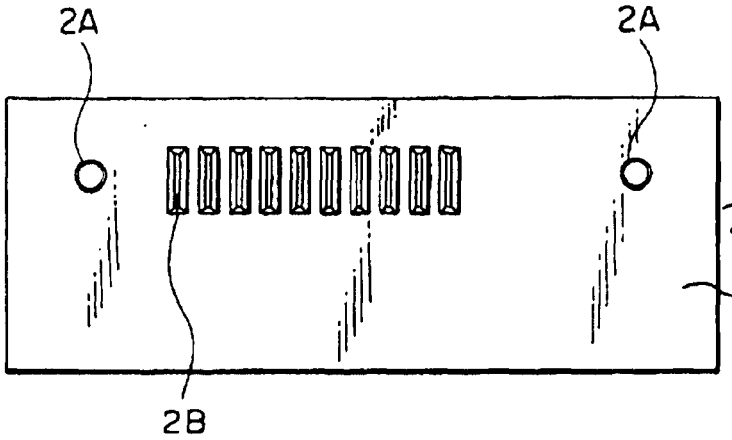
Figure 8D:
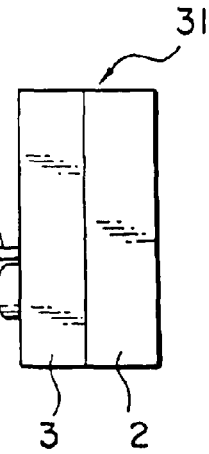
Figure 8B:
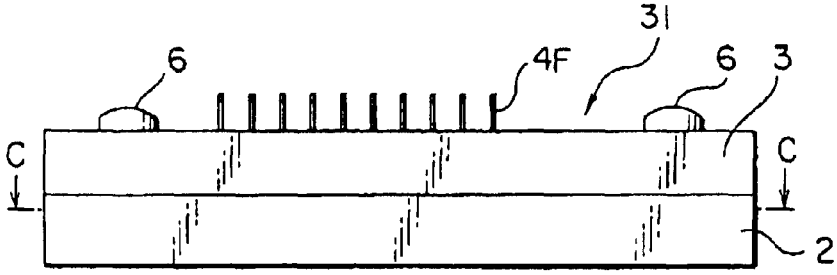
Figure 8C:
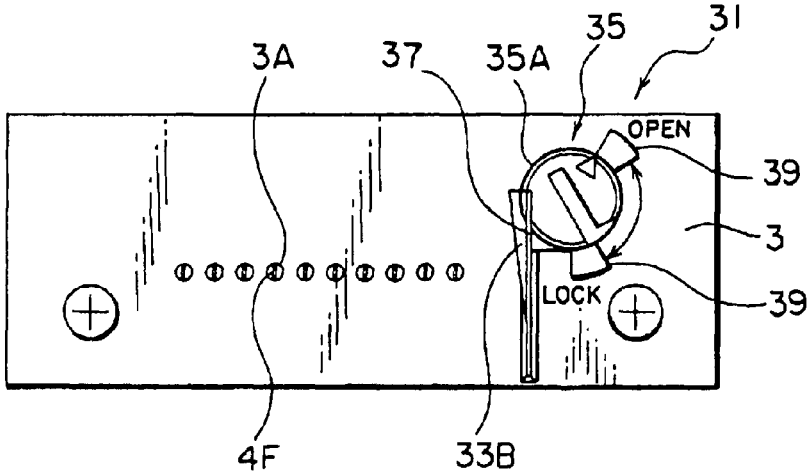
Figure 9A:
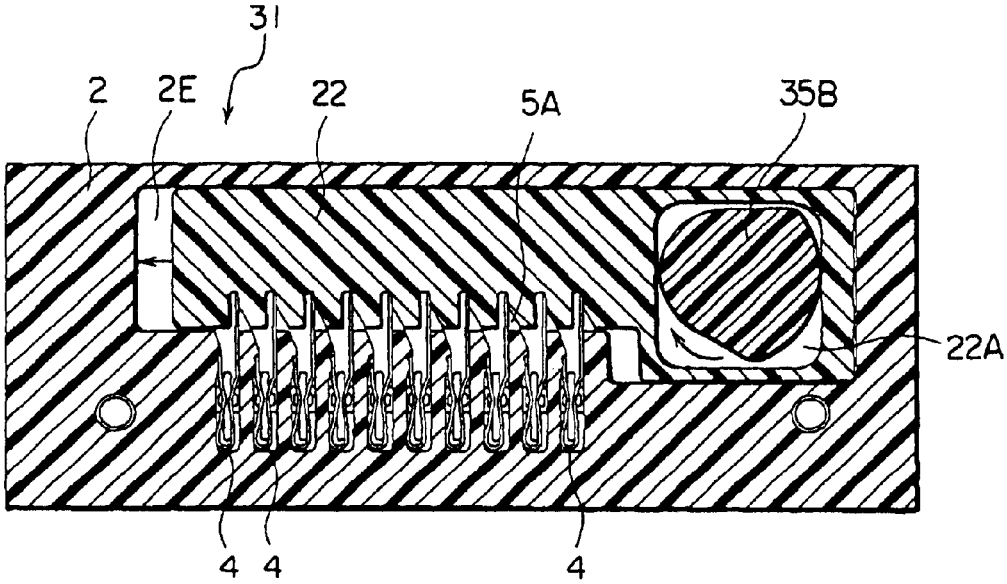
Figure 9B:
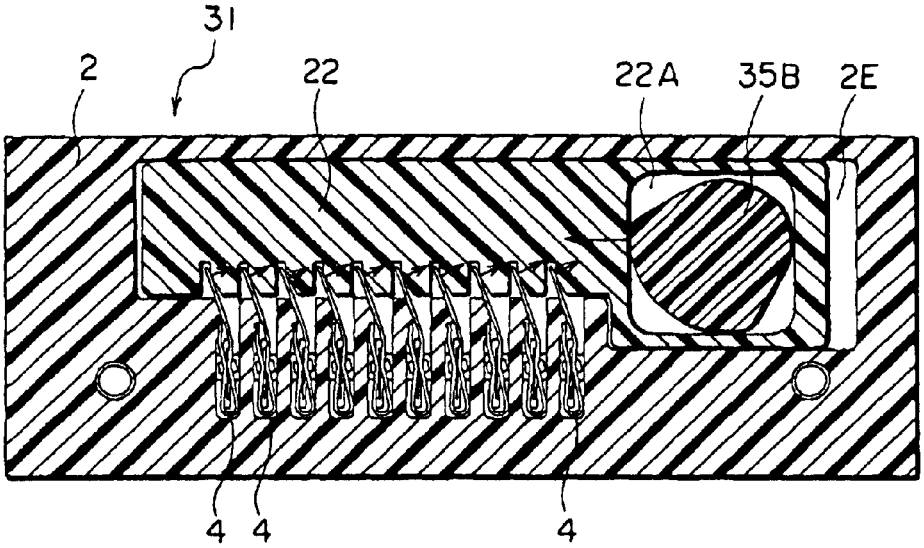

FIGS. 8A to 8D show a socket connector 31 being a ZIF connector with a lock mechanism according to the third embodiment of the present invention, wherein FIG. 8A is a front view, FIG. 8B is a plan view, FIG. 8C is a rear view, and FIG. 8D is a side view. FIGS. 9A and 9B are sectional views each taken along line C—C in FIG. 8B, wherein FIG. 9A shows the state before the pin connector 11 shown in FIGS. 2A to 2C is connected to the socket connector 31, while FIG. 9B shows the state after the pin connector 11 is connected to the socket connector 31.

The socket connector 31 comprises a front insulator 2 retaining a plurality of socket contacts 4, a base insulator 3 confronting the front insulator 2, and an actuator 22 (see FIG. 7A) slidably received between the front and base insulators 2 and 3. The actuator 22 has a cam hole 22A that receives therein a cam portion 35B forming a cam mechanism. When the cam portion 35B of the cam mechanism is rotated, the actuator 22 slides as shown in FIGS. 9A and 9B so that cam portions 5A1 of the actuator 22 displace movable portions 4E of the socket contacts 4 along movable portion grooves 5A of the actuator 22, respectively. This displacement of each movable portion 4E causes contact points 4B1 and 4D1 of the socket contact 4 to sandwich therebetween under pressure the pin 13B of the pin contact 13 of the pin connector 11 as a connection counterpart. The socket connector 31 further comprises a cam lock mechanism 35 that is provided on the side of the base insulator 3 for locking a fitted state between the socket contacts 4 and the pins 13B of the pin contacts 13, which is accomplished by the rotational operation of the cam portion 35B of the cam mechanism. The rotational operation of the cam portion 35B can be achieved in a known manner such as providing a shaft and a rotary lever coupled thereto, and thus no details thereof are given here.

As shown in FIG. 8C, the cam lock mechanism 35 comprises a cam lock operating portion 35A that is formed integral with the cam portion 35B of the cam mechanism and arranged at a predetermined portion on the side of the base insulator 3 so as to be exposed to the exterior. The cam lock operating portion 35A is rotated according to a change of the state including a fitted state between the socket contacts 4 and the pins 13B of the pin contacts 13 during connection between the socket connector 31 and the pin connector 11, and a disengaged state therebetween. The cam lock mechanism 35 further comprises a plate-like retaining spring 37 disposed in a spring groove 33B provided on the base insulator 3 in the vicinity of the cam lock operating portion 35A. The spring 37 has one end portion that is flexible and engages with a lock groove 35D formed at a peripheral portion of the cam lock operating portion 35A depending on a rotational position of the cam lock operating portion 35A, and the other end fixed to the base insulator 3 by press-fitting. Accordingly, the basic operations of engagement and disengagement between the socket contacts 4 and the pin contacts 13 achieved by the rotational operation of the cam portion 35B of the cam mechanism rely on the operation of the cam lock mechanism 35.

Figure 10A:
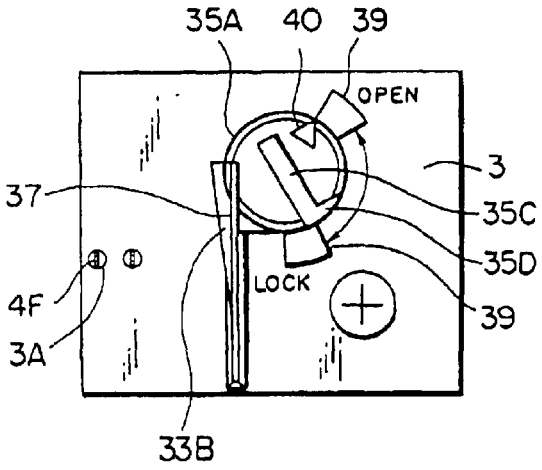
Figure 10B:
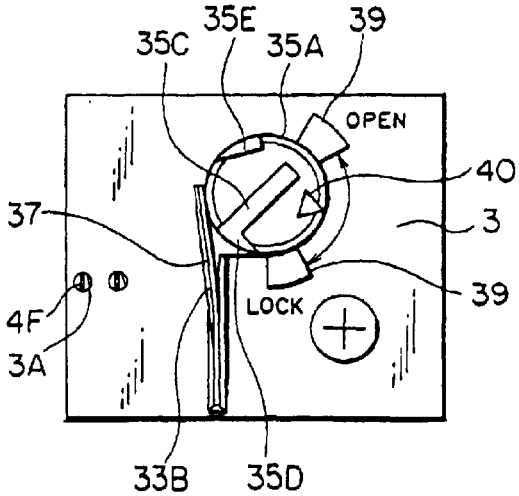
Figure 10C:
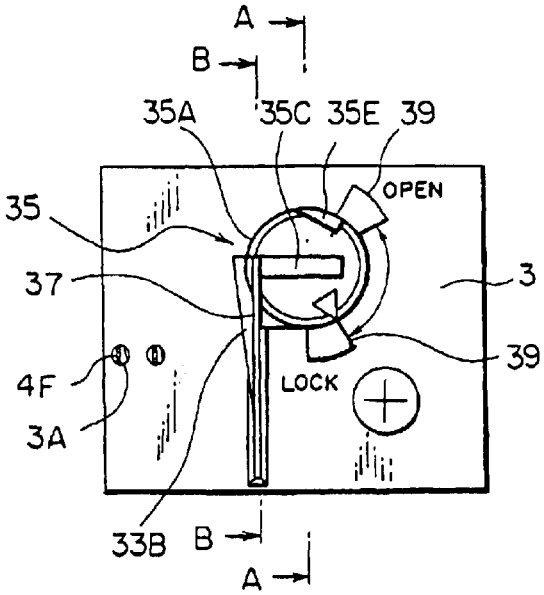
Figure 10D:
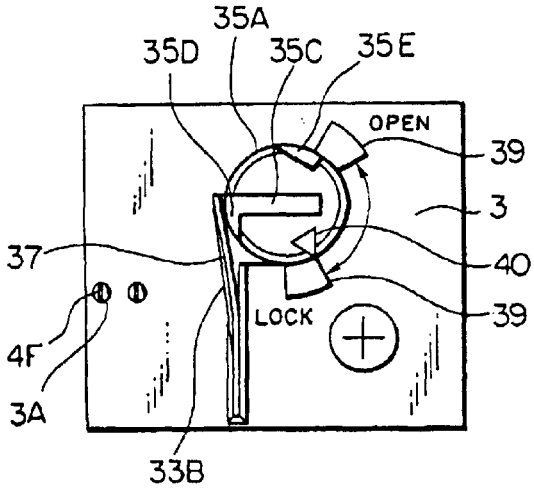
Figure 11A:
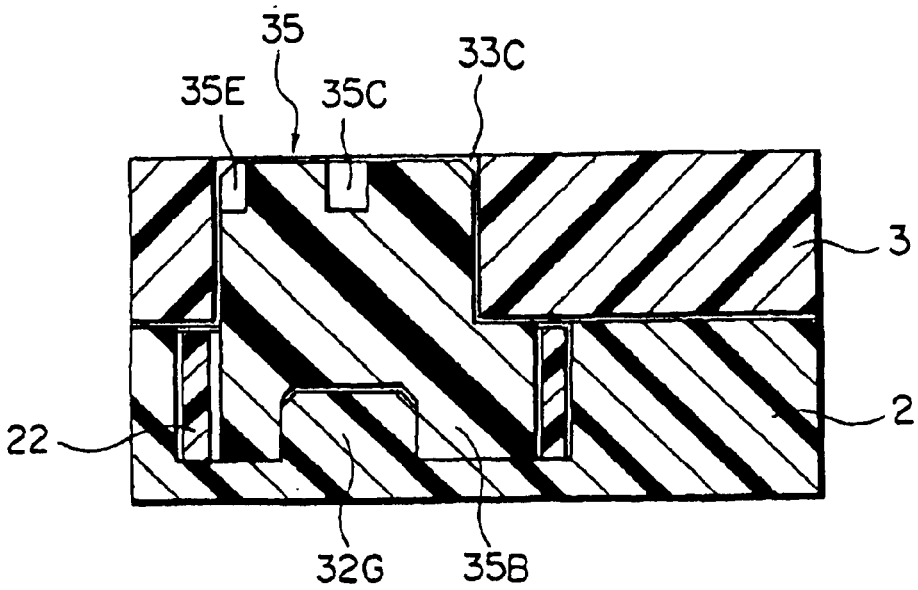
Figure 11B:
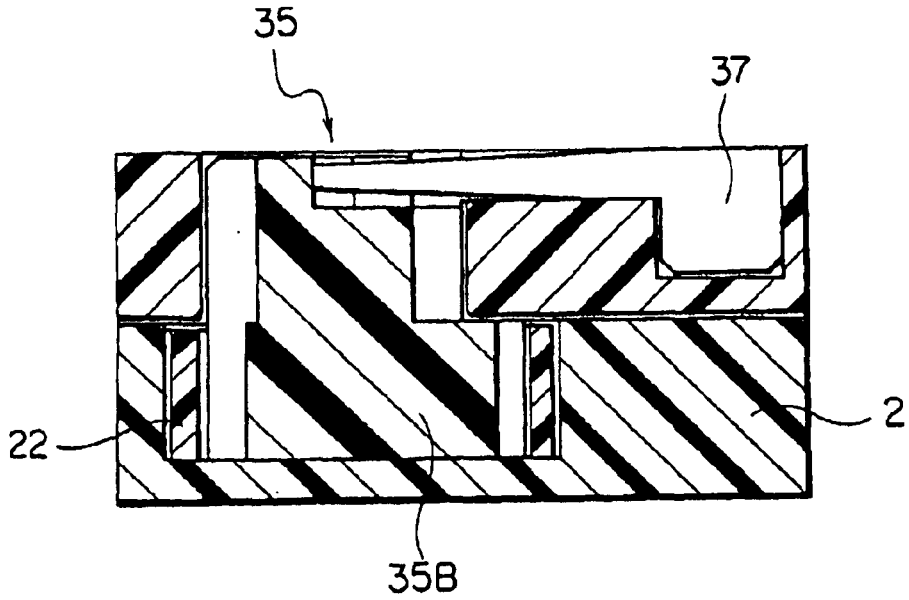
Figure 12:
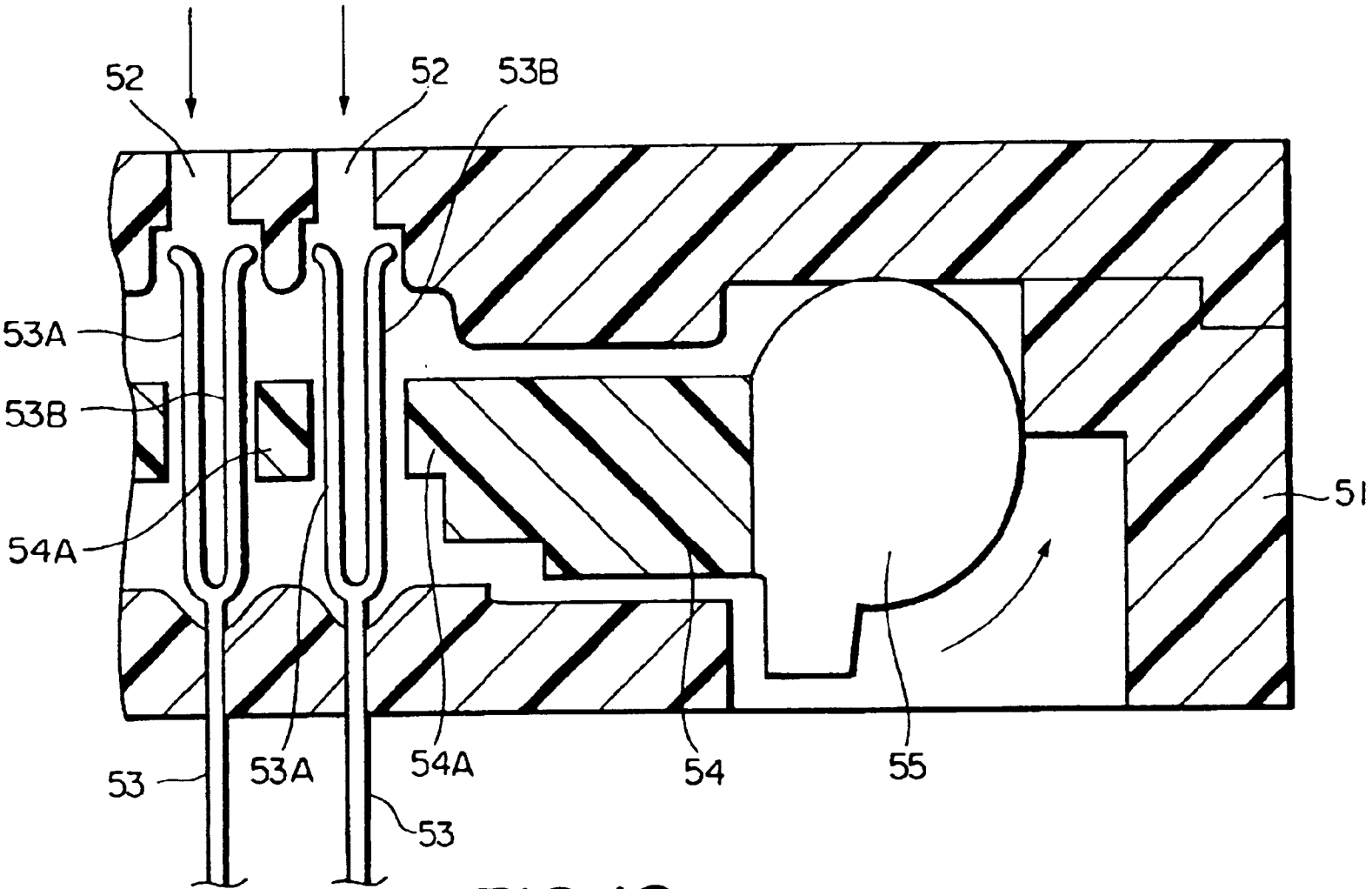
FIG. 12 PRIOR ART
FIG. 12 is a sectional view of a conventional ZIF connector.

FIGS. 10A to 10D are enlarged rear views showing the main part of FIG. 8C, wherein FIG. 10A shows an open state of the cam lock mechanism 35, FIG. 10B shows an intermediate state thereof from the open state to a lock state, FIG. 10C shows the lock state thereof, and FIG. 10D shows a state thereof upon releasing the lock state. FIGS. 11A and 11B are diagrams for explaining an internal structure of the cam lock mechanism 35, wherein FIG. 11A is a sectional view taken along line A—A in FIG. 10C, and FIG. 11B is a sectional view taken along line B—B in FIG. 10C.

Referring to FIGS. 10A to 10D, the surface of the cam lock operating portion 35A is substantially circular, and a belt-like groove 35C is formed on the surface thereof so as to extend in substantially a diametrical direction thereof. The belt-like groove 35C is used for rotating the cam lock operating portion 35A. The lock groove 35D is formed on the surface of the cam lock operating portion 35A so as to extend from the belt-like groove 35C in a direction perpendicular thereto. An open groove 35E is further provided on the surface of the cam lock operating portion 35A in a position spaced apart therefrom by a predetermined angle. The cam lock operating portion 35A is further provided on the surface thereof with an operating position indicator 40 at a predetermined portion thereof. On the base insulator 3 in the vicinity of the cam lock operating portion 35A, logo portions 39 representing LOCK (lock position) and OPEN (unlock position) are provided. The whole mechanism including the cam lock operating portion 35A and the retaining spring 37 are arranged so as not to project from the surface of the base insulator 3. Referring to FIGS. 11A and 11B, the cam lock operating portion 35A and the cam portion 35B are rotatable with the center of a cam shaft 32G provided on the front insulator 2 and the center of a cam hole 33C provided in the base insulator 3 as a rotation axis.

In the open state of the cam lock mechanism 35 shown in FIG. 10A (the disengaged state between the socket contacts 4 and the pin contacts 13), the operating position indicator 40 is located at a counterclockwise end of the logo portion 39 representing the unlock position (OPEN), wherein the free end of the retaining spring 37 in the spring groove 33B engages with the open groove 35E, so that the cam lock operating portion 35A is prevented from rotation in the counterclockwise direction, while is rotatable in the clockwise direction.

In the intermediate state of the cam lock mechanism 35 shown in FIG. 10B, the cam portion 35B is rotated in the clockwise direction, and thus the cam lock operating portion 35A corotates in the clockwise direction, so that the operating position indicator 40 is located in an intermediate position between the unlock position (OPEN) and the lock position (LOCK). In this intermediate position, the free end portion of the retaining spring 37 in the spring groove 33B is elastically deformed and released from the open groove 35E, so that the cam lock operating portion 35A is rotatable in both counterclockwise and clockwise directions.

Then, in the lock state of the cam lock mechanism 35 shown in FIG. 10C (the fitted state between the socket contacts 4 and the pin contacts 13) where the cam portion 35B is further rotated in the clockwise direction from the intermediate state so that the socket contacts 4 are connected to the pin contacts 13, the cam lock operating portion 35A corotates in the clockwise direction so that the operating position indicator 40 is located at an end of the logo portion 39 representing the lock position (LOCK). In this lock position, the free end of the retaining spring 37 in the spring groove 33B engages with the lock groove 35D, so that the cam lock operating portion 35A is prevented from rotation in the counterclockwise direction, and thus the lock function is automatically activated against the cam mechanism.

In the lock releasing state of the cam lock mechanism 35 shown in FIG. 10D where the foregoing lock state is released, the free end of the retaining spring 37 is pushed away from the lock groove 35D, i.e. in a direction opposite to a biasing direction toward a wall of the lock groove 35D, so as to release the engagement between the retaining spring 37 and the lock groove 35D, then in this state, a minus driver is engaged with the belt-like groove (minus groove) 35C thereby to rotate the cam lock operating portion 35A in the counterclockwise direction, so that the cam portion 35B corotates in the counterclockwise direction. By rotating the cam lock operating portion 35A and the cam portion 35B in the counterclockwise direction, the free end of the retaining spring 37 in the spring groove 33B engages with the open groove 35E as shown in FIG. 10A, wherein the fitted state between the socket contacts 4 and the pin contacts 13 is released by the simultaneous movement of the cam portion 35B.

As described above, according to the foregoing third embodiment, the cam lock mechanism 5 is provided for reliably retaining the fitted state between the socket contacts 4 and the pin contacts 13, which is achieved by the rotational operation of the cam portion 35B of the cam mechanism. Therefore, even if a load such as vibration or impact is applied from the exterior during such a fitted state, the fitted state can be stably maintained so that the reliability of connection between the socket connector 31 and the pin connector 11 can be highly enhanced.

As appreciated, the third embodiment is essentially the same as the foregoing first and second embodiments other than the cam mechanism added with the cam lock mechanism. Accordingly, those effects achieved by the first and second embodiments are also attained in the third embodiment.

In the foregoing third embodiment, the cam mechanism is of the rotationally operated type. However, instead of it, the slidingly operated type may be used to drive the actuator. Further, each socket contact 4 may have other shapes as long as the cam portion 5A1 of the actuator 5 can displace a movable portion 4E of a socket contact thereby to sandwich under pressure the pin contact 13 inserted in a gap of the socket contact.

What is claimed is:

1. A ZIF connector comprising an insulator, a contact held by said insulator, and an actuator slidably held by said insulator, said contact comprising:

a stationary portion fixed to said insulator;

a first portion having a first contact point and being continuous with said stationary portion;

a substantially U-shaped portion continuous with said first portion;

a second portion having a second contact point and being continuous with said substantially U-shaped portion; and a movable portion continuous with said second portion and engaging with said actuator, said first and said second contact points confronting each other with a gap left therebetween, said movable portion confronting said stationary portion and extending longer than said stationary portion and said actuator sliding to displace said movable portion so that said first and said second contact points sandwich therebetween a connection counterpart that is inserted in said gap.

2. The ZIF connector according to claim 1, wherein said first and said second portions are preformed to have intermediate portions, respectively, which are approached to each other to make said gap become small.

3. The ZIP connector according to claim 1, further comprising guides extending from said first and said second contact points, respectively, for introducing said connection counterpart into said gap.

4. The ZIF connector according to claim 1, further comprising a lock mechanism coupled to said actuator for locking a state where said connection counterpart is sandwiched between said first and said second contact points.

5. The ZIF connector according to claim 1, further comprising a driving screw screwed in said insulator and coupled to said actuator for moving said actuator relative to said insulator.

6. The ZIF connector according to claim 1, further comprising a cam portion rotatably held by said insulator and coupled to said actuator for moving said actuator relative to said insulator.

7. The ZIF connector according to claim 6, further comprising a lock mechanism coupled to said cam portion for locking a fitted state where said connection counterpart is sandwiched between said first and second contact points.

8. The ZIF connector according to claim 7, wherein said lock mechanism comprises:

a cam lock operating portion formed integral with said cam portion and having a lock groove provided at a peripheral portion of said cam lock operating portion; and a retaining spring held by said insulator for engaging with said lock groove in dependence on an operating position of said cam lock operating portion to make said cam lock operating portion be prevented from being moved to release said fitted state.

9. The ZIF connector according to claim 8, wherein said cam lock operating portion has an operating position indicator showing an operating position of said cam lock operating portion, said insulator having, in the vicinity of said cam lock operating portion, logo portions representing a lock position and an unlock position.

10. The ZIF connector according to claim 7, wherein said cam lock mechanism is arranged so as not to project from the surface of said insulator.

11. A ZIF connector comprising:

an insulator holding a plurality of first contacts;

an actuator slidably holding by said insulator; and a cam mechanism having a cam portion, wherein, when said cam portion is operated to slide said actuator, said actuator displaces movable portions of said first contacts so that said first contacts and a plurality of second contacts of a connection counterpart are brought into a fitted state where said first contacts are connected to said second contacts, respectively; and a cam lock mechanism for retaining said fitted state;

said cam lock mechanism comprising:

a cam lock operating portion that is formed integral with said cam portion, disposed at a predetermined portion of said insulator so as to be exposed to the exterior, and operated so as to correspond to a change of a state including said fitted state and a disengaged state where said first and second contacts are non-connected to each other; and a plate-like retaining spring that is disposed in a spring groove provided on said insulator in the vicinity of said cam lock operating portion, and has one end portion which is flexible and engages with a lock groove provided at a peripheral portion of said cam lock operating portion depending on an operating position of said cam lock operating portion, and the other end portion fixed to said insulator, wherein, when said cam portion is operated to slide said actuator to provide said fitted state, said cam lock operating portion moves, being unified with said cam portion, in one direction so that said one end portion of said retaining spring engages with said lock groove, thereby to automatically lock said cam mechanism.

12. The ZIF connector according to claim 11 wherein, upon releasing said fitted state, said one end portion of said retaining spring is pushed in a direction opposite to a biasing direction toward a wall of said lock groove so as to release engagement between said retaining spring and said lock groove, then in this state, said cam lock operating portion is moved in a direction opposite to said one direction, thereby to simultaneously move said cam portion to release said fitted state.

13. The ZIF connector according to claim 12, wherein said cam lock operating portion is rotationally operated, has a substantially circular surface, and is formed with a belt-like groove extending in a substantially diametrical direction thereof, and said lock groove extends from said belt-like groove in a direction perpendicular thereto, wherein, when said cam portion is rotated to slide said actuator to provide said fitted state, said cam lock operating portion corotates in one direction so that said one end portion of said retaining spring engages with said lock groove, thereby to automatically lock said cam mechanism, and wherein, upon releasing said fitted state, said one end portion of said retaining spring is pushed in a direction opposite to a biasing direction toward a wall of said lock groove so as to release engagement between said retaining spring and said lock groove, then in the state, said cam lock operating portion is rotated in a direction opposite to said one direction-using said belt-like groove, thereby to corotate said cam portion to release said fitted state.

14. The ZIP connector according to claim 13, wherein said cam lock operating portion has an operating position indicator showing an operating position of said cam lock operating portion, said insulator having, in the vicinity of said cam lock operating portion, logo portions representing a lock position and an unlock position.

15. The ZIF connector according to claim 11 wherein the whole of said cam lock mechanism including said cam lock operating portion and said retaining spring is arranged so as not to project from the surface of said insulator.

16. The ZIF connector according to claim 11, wherein each of said first contacts comprises:

a stationary portion fixed to said insulator;

a first portion having a first contact point and being continuous with said stationary portion;

a substantially U-shaped portion continuous with said first portion;

a second portion having a second contact point and being continuous with said substantially U-shaped portion, and said second contact point confronting said first contact point with a gap defined therebetween; and a movable portion continuous with said second portion and engaging with said actuator, said first and said second portions being preformed to have intermediate portions, respectively, which are approached to each other to make said gap become small, wherein, when said cam portion is operated to slide said actuator, said actuator displaces said movable portions of said first contacts so that said first contact points and said second contact points sandwich therebetween said second contacts that are inserted in said gaps, respectively.

17. The ZIF connector according to claim 1, wherein said first portion comprises a first (-shaped portion having an apex as said first contact point, said second portion comprising a second (-shaped portion having an apex as said second contact point, said first and said second portions further comprising guides, respectively, which are symmetrically formed outward from said first and said second contact points.

18. A ZIF connector comprising an insulator, a contact held by said insulator, and an actuator slidably held by said insulator, said contact comprising;

a stationary portion fixed to said insulator;

a first portion having a first contact point and being continuous with said stationary portion;

a substantially U-shaped portion continuous with said first portion;

a second portion having a second contact point and being continuous with said substantially U-shaped portion;

a movable portion continuous with said second portion and engaging with said actuator, said first and said second contact points confronting each other with a gap left therebetween, said actuator sliding to displace said movable portion so that said first and said second contact points sandwich therebetween a connection counterpart that is inserted in said gap;

a cam portion rotatably held by said insulator and coupled to said actuator for moving said actuator relative to said insulator; and a lock mechanism coupled to said cam portion for locking a fitted state where said connection counterpart is sandwiched between said first and said second contact points;

said lock mechanism comprising:

a cam lock operating portion formed integral with said cam portion and having a lock groove provided at a peripheral portion of said cam lock operating portion; and a retaining spring held by said insulator for engaging with said lock groove in dependence on an operating position of said cam lock operating portion to prevent said cam lock operating portion from being moved to release said fitted state.

* * * * *

UNITED STATES PATENT AND TRADEMARK OFFICE

CERTIFICATE OF CORRECTION

PATENT NO. : 6,890,201 B2
DATED : May 10, 2005
INVENTOR(S) : Hashiguchi et al.

It is certified that error appears in the above-identified patent and that said Letters Patent is hereby corrected as shown below:

Column 9,
Line 6, please insert a comma after the word “portion.”.

Column 10,
Line 45, please change “direction-using” to correctly read -- direction using --.
Line 48, please change “ZIP” to correctly read -- ZIF --.

Column 11,
Line 14, after the word “first” please change “(-” to -- <- --.
Line 16, after the word “second” please change “(-” to -- <- --.

Signed and Sealed this

Sixteenth Day of August, 2005

JON W. DUDAS
*Director of the United States Patent and Trademark Office*